US005282131A

United States Patent [19]

Rudd et al.

[11] Patent Number: 5,282,131

[45] Date of Patent: Jan. 25, 1994

[54] CONTROL SYSTEM FOR CONTROLLING A PULP WASHING SYSTEM USING A NEURAL NETWORK CONTROLLER

[75] Inventors: John B. Rudd; David L. DeGroot, both of Mobile, Ala.

[73] Assignee: Brown and Root Industrial Services, Inc., Mobile, Ala.

[21] Appl. No.: 823,313

[22] Filed: Jan. 21, 1992

[51] Int. Cl.[5] ..... G06F 15/46; D21C 9/02

[52] U.S. Cl. ..... 364/164; 364/471; 395/23; 162/49; 162/60; 162/253

[58] Field of Search ..... 364/148, 162, 164, 471; 395/20, 21, 23; 162/49, 60, 252, 253, 258

[56] References Cited

U.S. PATENT DOCUMENTS

| | | | |
|---|---|---|---|
| 4,207,141 | 6/1980 | Seymour | 162/49 |
| 4,840,704 | 6/1989 | Seymour | 162/49 |
| 5,111,531 | 5/1992 | Grayson et al. | 395/23 |

*Primary Examiner*—Jerry Smith
*Assistant Examiner*—Paul Gordon
*Attorney, Agent, or Firm*—Webb, Burden, Ziesenheim & Webb

[57] ABSTRACT

A control system for a countercurrent pulp washing process in which the pulp is formed as a pulp mat on at least one moving filter surface and the mat is supplied with rinse water to replace water in the pulp mat thereby reducing the soda loss in the mat before it is removed from the filter surface. The process is characterized by at least one predictable process variable including dissolved solids retained in the pulp mat. The system comprises a trainable neural network having a plurality of input neurons having input values applied thereto and output neurons for providing output values and means for training the neural network to provide predicted values for the predictable process variables.

3 Claims, 6 Drawing Sheets

CONTROL SYSTEM FOR CONTROLLING A PULP WASHING SYSTEM USING A NEURAL NETWORK CONTROLLER

BACKGROUND AND DISCUSSION OF PRIOR ART

This invention relates to new and useful improvements in the control of a pulp washing system to remove the maximum amount of dissolved organic and soluble inorganic material present in a pulp slurry undergoing treatment by a pulp washing system while at the same time minimizing the amount of fresh or other reused process water. More specifically, the invention relates to the use of techniques to develop, implement and use a neural network to dynamically monitor and adjust a pulp washing system to obtain an optimum balance between total solids removed from the pulp slurry entering a pulp washing system and the residual unremoved solids present in the pulp slurry as it leaves the washing system, often referred to as soda loss or carry-over.

FIG. 1 illustrates a typical single pulp washer. A pulp slurry stream 22 enters an inlet repulper 10 where it is admixed with a reused process water flow 9, interchangeably referred to as filtrate, to form an admixture of pulp and contaminated water solution. One or more repulper beaters are located in the repulper box to thoroughly mix the admixture which then flows over a weir 13 into the washer vat 2. The washer drum 1 is covered by a filter media 12, generally a mesh cloth of plastic or metal called the face, rotating in the direction shown by arrow 3 where part of the drum is submerged in a pulp slurry contained in a vat 2. A lower pressure inside the drum 1, due to a barometric leg or vacuum source hence the name vacuum drum, extracts the contaminated water solution from the pulp slurry with the pulp forming a mat 4, interchangeably called a sheet or cake, on the face of the filter media 12 in the sheet forming zone 14. As the sheet 4 emerges from the slurry, it enters a drying zone 15 where additional water solution is removed from the mat. As the drum rotates, the mat passes into the displacement zone 16. A stream of fresh water 6 (shower flow), or reused process water, is sprayed onto the mat by shower 5 and displaces the more contaminated vat liquor from the mat. The mat then passes another drying zone 17 and finally a discharge zone 18 where the mat is removed from the face by a removal device 19 and discharged to pass to another washer or another part of the process that is not shown and is not related to this invention.

In some cases, a washer will operate singly as described (for example a bleach pulp washer or a pulp decker/thickener), however, in many cases a plurality of washers are combined to form a complete washing system as shown in FIG. 2. Referring to this figure, three washers are operating together to form the washing system where the pulp slurry passes from washer to washer and reused filtrate is passed from washer to washer in the opposite direction, called countercurrent washing. A pulp slurry stream 22 is introduced into the repulper and is admixed with dilution stream 23. The balance of the system is made up of washers 1, 1' and 1'' rotating in directions indicated by arrows 3, 3' and 3'' inside vats 2, 2' and 2'' discharging mats 7, 7' and 7''. Water streams 6, 9' and 21' are introduced via showers 5, 5' and 5'' with the final pulp mat being discharged from the system as pulp slurry stream 24. Typically, the only fresh water is in stream 6. The filtrate removed from the mats on washers 8, 8' and 8'' pass into filtrate storage tanks 20, 20' and 20''. The filtrate from storage tanks 20 and 20' become dilution streams 9 and 21 into repulpers 10 and 10', respectively. Side streams 9' and 21' split off the main dilution streams and pass to showers 5 and 5'. The filtrate from storage tank 20'' becomes dilution stream 23 to repulper 10'' with a side stream 23' that passes out of the system to a chemical recovery process that is not shown and is not considered as a part of this invention.

In the single and multiple pulp washing systems described with reference to FIGS. 1 and 2, there are actually two process cycles that must be considered and controlled. Referring to FIG. 2, one process cycle is the actual pulp mass moving through the pulp washing system with a time cycle of typically less than ten minutes from the time the pulp mass enters the first washer, as pulp slurry 22, until it leaves the last washer, as pulp slurry 24. The second process cycle is the reused wash liquor cycle made up of fresh water and other reused process water, streams 6, 9' and 21', interchangeably called filtrates, which have a time cycle in the range of two to four hours from the time fresh water stream 6 is added on the last shower until the filtrate leaves the first storage tank 20'' as dilution stream 23 and wash liquor stream 23' going to the chemical recovery system that is not shown.

Attempts to control wash water flow 6 by measuring the solids content of the wash liquor stream 23', going to the recovery system, by a measurement means 25, either manually done or by continuous sensor means, is difficult at best due to the tremendous lag times (typically 2–4 hours) between the time a change is made and the results are measured. The actual controls that take place must relate to the control of the shower water applied during the short time of the pulp flow cycle represented by the passing of the pulp slurry from entering pulp slurry stream 22 to exiting pulp slurry stream 24.

Ideally, the pulp slurry stream 24 carries the minimum amount of soluble organic and inorganic materials because these must be reacted with chemicals in a later process stage and replaced when the liquor stream 23' is processed by a spent chemical recovery system. The fewer the soluble materials in the washed pulp stream, the less the expense for chemicals used and chemical make-up in the recovery cycle. The wash liquor stream 23' cannot simply be sewered due to its potentially adverse effect upon the environment. By evaporation, the solubles are separated and water is reused. Therefore, the less water in the wash liquor stream the better. The soluble and insoluble materials in the wash liquor stream are combustible and can be used as a source of energy. In an actual pulp washing system, there is always competition between the amount of spent chemicals recovered and the capacity of the recovery process to evaporate the filtrate produced by the washers. Minimizing the chemicals lost with the pulp leaving the system is obviously prudent; however, reducing this to the absolute minimum would require infinite dilution which is impractical. Compromises must be made, often on an hourly or daily basis, such that the capacity of the recovery process is not exceeded while the chemical losses are minimized.

Prior methods of control of pulp washing systems depended on an operator observing the operation and adjusting the control parameters based upon his own knowledge and past experience. Historically, human operators have only been marginally effective at controlling the black liquor solids content of the liquor side stream (see FIG. 2, stream 23') leaving the system going to the recovery system (not shown). This is due to the lag times (usually 2–4 hours) between changes to the shower flow 6 on the last stage shower 5 and the resulting effect in terms of the measured solids content of the wash liquor stream 23' leaving the first stage filtrate tank 20''. A real problem exists due to the fact that normal short-term fluctuations in the liquor solids are confused with expected long-term shifts in liquor solids that are results of past adjustments that have been made. This confusion results in unnecessary adjustments or the omission of a necessary adjustment.

Later, as a better understanding of the process became known, relational control concepts were developed and used. In relational control, a control factor is calculated from values of certain process variables and the values of controlled process variables are adjusted to bring the control factor to or near to a target value. Two of the most prevalent of these relational concepts are Dilution Factor (DF) control and Displacement Ratio (DR) control.

The development of Dilution Factor is credited to Leintz in an article titled "The Dilution Curve—Its Use in the Correlation of Pulp Washing and Evaporation," published by Waters and Bergstrom in 1955. According to this article, the DF relationship is used to predict spent liquor solids concentration from rotary drum washing systems based upon certain known operating conditions derived from analytical tests performed manually during operating trials. These results could then be used for design considerations or for determining present operating efficiency of a system.

The Displacement Ratio concept was introduced by Perkins, Welsh and Mappus in an article entitled "Brown Stock Washing Efficiency, Displacement Ratio Method of Determination." This method introduced to the industry another method of determining washing efficiency.

Regardless of the relational control concept proposed, it is required that various process conditions be monitored on a continuous basis such that automated control systems can respond in a manner that maintains the optimum slurry washing for the given conditions. Modern instrumentation systems have long been available that will measure, with reasonable accuracy, the flow rates, temperatures of materials, liquid levels within vessels, relative position of actuator devices and concentrations of various fluid process streams. Systems for measuring mass flow rates and concentration of solid streams, such as that leaving the pulp washing device, are also available; however, these devices are of questionable reliability and require verification by manual testing which can be performed on an hourly basis at best. The result is that continuous processes must be controlled using calculated parameters based on empirical relationships that may or may not be related to dynamic control components in the control system.

Both of the DF and DR concepts were addressed in Seymore U.S. Pat. No. 4,207,141 as related to the continuous control of washing systems, however, slightly different definitions of DF and DR were given than normally used. These control concepts were extended as described in Seymore U.S. Pat. No. 4,840,704 which relates to the control of washer speed to control the inlet consistency and improve washer mat formation and increase washing efficiency. In these methods, there is a requirement to continuously and instantaneously determine the consistency of the pulp mat leaving the washer, where consistency is defined as the ratio of solid pulp mass contained in the pulp stream to the total mass rate (pulp and water) contained in the stream expressed as a percentage. Consistencies and weighting factors are assigned and relate to the nonavailability of on-line measuring devices that can accurately and repeatedly measure the solids content of the fibrous mat leaving the face of the rotating washer.

In recent years, there has been a resurgence in the use of statistical control concepts to affect control over operating processes. Initially, the statistical control programs were basically manual operations performed on an hourly basis by operators that allow them to determine that statistically significant changes have occurred. Based upon their past experience, they can decide whether some action, if any, is warranted. Presently, these programs are typically aimed at identifying the need for operator involvement and understanding of the concepts needed to address the problem typically encountered when large lag times exist between the controlled parameter and the variable that is being Controlled.

This invention overcomes the problems of the prior art processes, including manual control, continuous control based upon attempts to continuously measure mat consistency and statistical control, by use of a trained neural network to predict the value of certain process variables that cannot be directly controlled. This invention is closely related to that disclosed in Grayson and Rudd U.S. Pat. No. 5,111,531 entitled "Process Control Using Neural Network" and incorporated herein by reference. Neural networks are developed and trained using a plurality of measurements, both manual and automatic, to consistently provide continuous outputs that are both repeatable and representative of process variables that have previously been assumed or arrived at by correlation.

The neural network controller is trained so that when production rates are changed from one level to another, historical experience is used to adjust the flow rates in a manner that obtains optimum operating conditions at various fractions of the time constant for each particular pulp washing system. Consequently, when operators make changes to the pulp stock input to the pulp washing system, they need no longer merely wait for changes to occur in the liquor stream some hours later to respond manually, but they can allow the system to dynamically adjust for the change as in a feed forward manner eliminating the problems associated with the long lag in response time.

The combination and accomplishment of all of the above is due to the neural network controller looking at a plurality of variables, including, but not limited to, process inputs from the operating control system, historical data, manual inputs from test results, and outputs from statistical analysis on washer operation to predict, for example, values for pulp mat consistency, pulp mat density, soda loss, black liquor solids, dilution factor and displacement ratio that can be used in relational control schemes or other control schemes.

The neural network controller provided in a closed loop control system for pulp washing systems according to this invention adjusts the set points of controlled variables to provide a higher level of process optimization for pulp washing systems than has been achievable in the past.

SUMMARY OF THE INVENTION

Briefly, according to this invention, there is provided a system for controlling a countercurrent pulp washing process. In a countercurrent pulp washing process, a pulp mat is formed on at least one moving filter surface. The pulp mat comprises pulp and retained water and/or other reused filtrate. The mat is sprayed with rinse water to replace the retained water in the pulp mat before the mat is removed from the filter surface. In this way, the dissolved organic and inorganic material in the retained water in the pulp mat is reduced. The dissolved organic and inorganic material is referred to as "soda loss," washing loss or dissolved solids.

The washing process is characterized by (i) measured and controlled process variables, (ii) measured and uncontrolled process variables, and (iii) at least one predictable process variable. The measured and controlled process variables include the rate of rinse water flow. The measured and uncontrolled process variables may include, for example, washer vat levels, temperatures, filter surface speed and stock flow rate to the countercurrent washer. Predictable process variables are variables which are not instantaneously measured but are instantaneously predicted by a trained neural network.

The system comprises sensors for detecting the values of the measured process variables whether those variables are controlled or uncontrolled. The sensors include, for example, liquid level sensors, temperature sensors and liquid flow rate sensors.

The system comprises controllable devices for changing the values of controllable process variables. The controllable devices, for example, motors connected to valves, establish the value of the variable at a set point value applied to the device. Preferably, the controllable devices include active elements, for example, motors with feedback controllers that compare the values of the directly controlled variables with set point values and generate error signals which when applied to the active elements drive the active elements to diminish the error signals. Most preferably, the active controllers are PID controllers.

The system comprises a trainable neural network having a plurality of input neurons for having input values applied thereto and at least one output neuron for outputting an output value. A neural network may be implemented as an integrated circuit defining the neural network including circuitry for implementing a teaching algorithm, or as a computer program defining the neural network and the teaching algorithm.

The system comprises computer means having a memory for maintaining a process description database defining the state of the process. The database includes the instantaneous values of the measured process variables. Circuitry and associated computer tasks are arranged for continuously updating the process database. Circuitry and computer tasks are also provided for applying set point values to the controllable devices.

The system further comprises computer means for calculating a calculated control factor from the value of the at least one predictable variable and, optionally, from the values of measured variables. The calculated control factor is then compared with a set point control factor. The set points of controlled variables including at least the rate of fresh rinse water is changed to reduce the difference between the calculated control factor and the set point control factor.

In a preferred embodiment, the control factor is Dilution Factor. In another preferred embodiment, the control factor is Displacement Ratio.

BRIEF DESCRIPTION OF THE DRAWINGS

Further features and other objects and advantages will become clear to those of ordinary skill in the art from the following description made with reference to the drawings in which.

DESCRIPTION OF THE PREFERRED EMBODIMENTS

Figure 1:
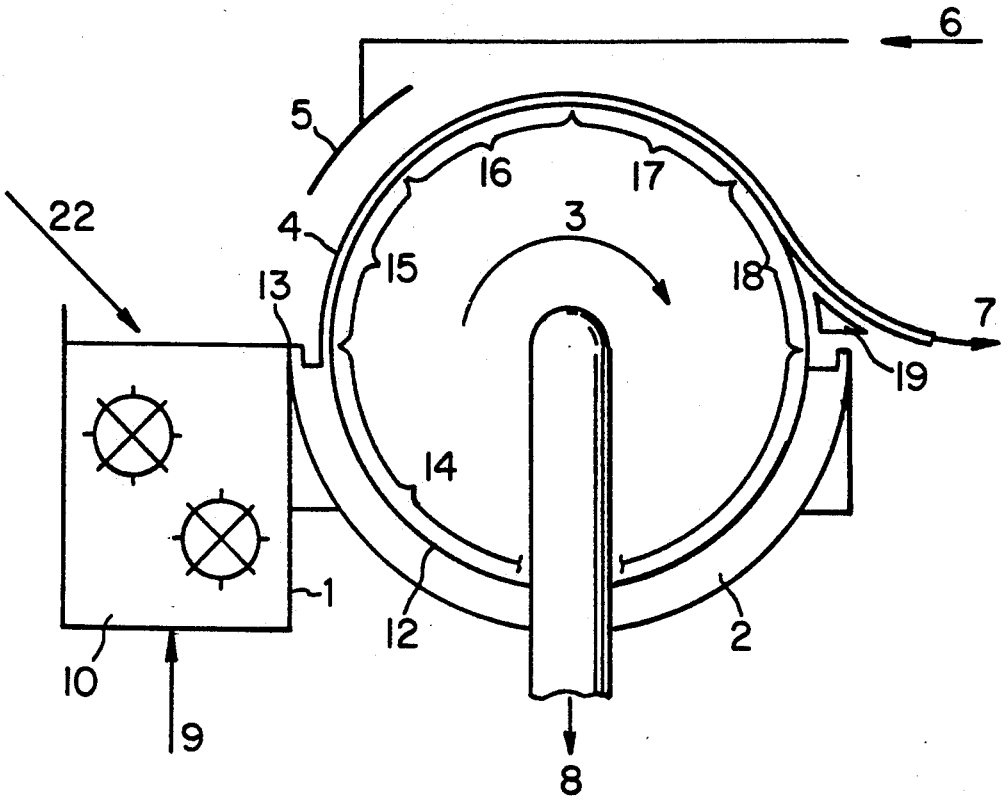
Fig. 1 PRIOR ART
FIG. 1 is a schematic diagram of a prior art single vacuum drum pulp washer that can operate in a standalone configuration or as a part of a multistage countercurrent pulp washing system as shown in FIG. 2.
Figure 2:
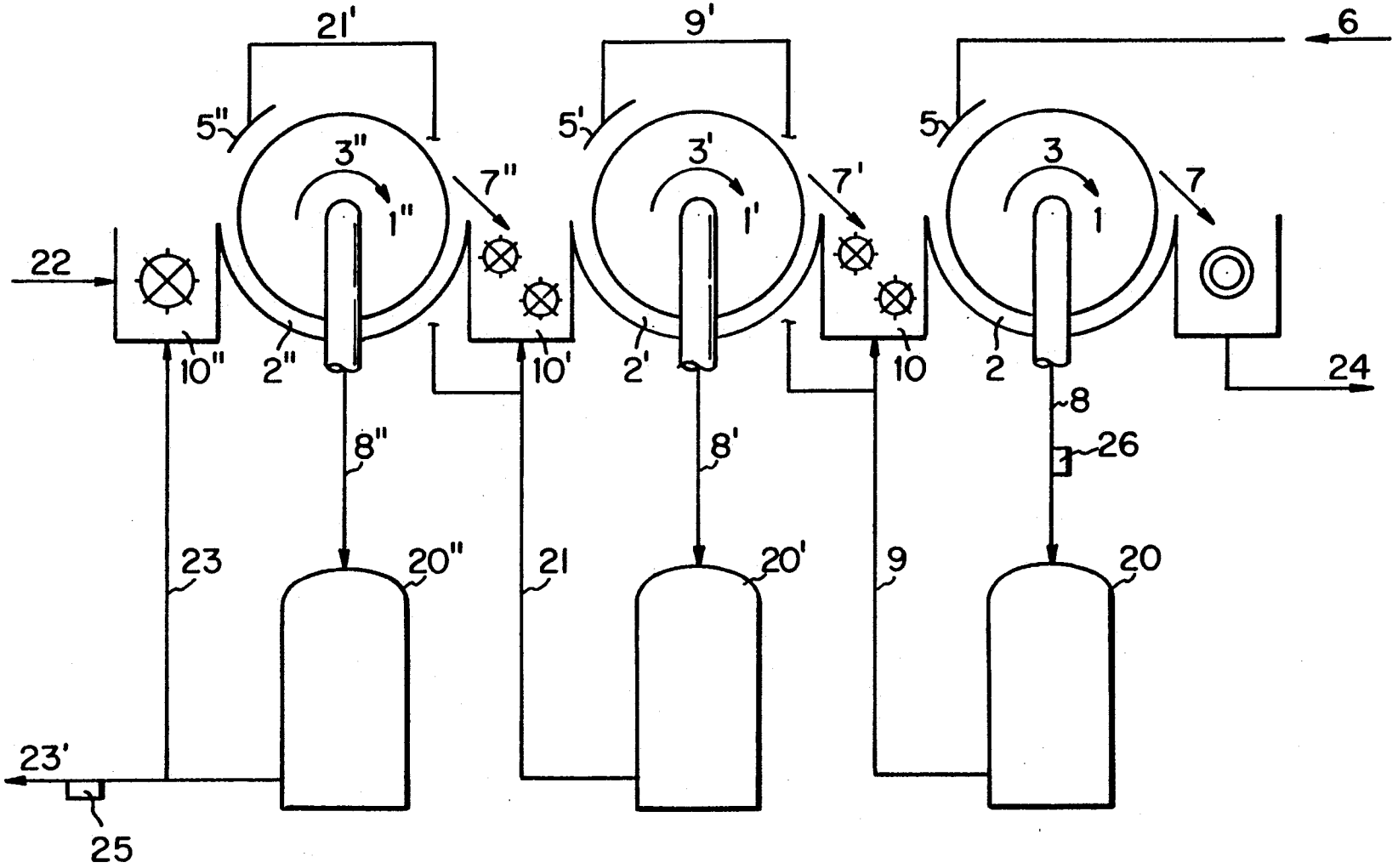
Fig. 2 PRIOR ART
FIG. 2 is a schematic of a prior art multistage countercurrent pulp washing system.
Figure 3:
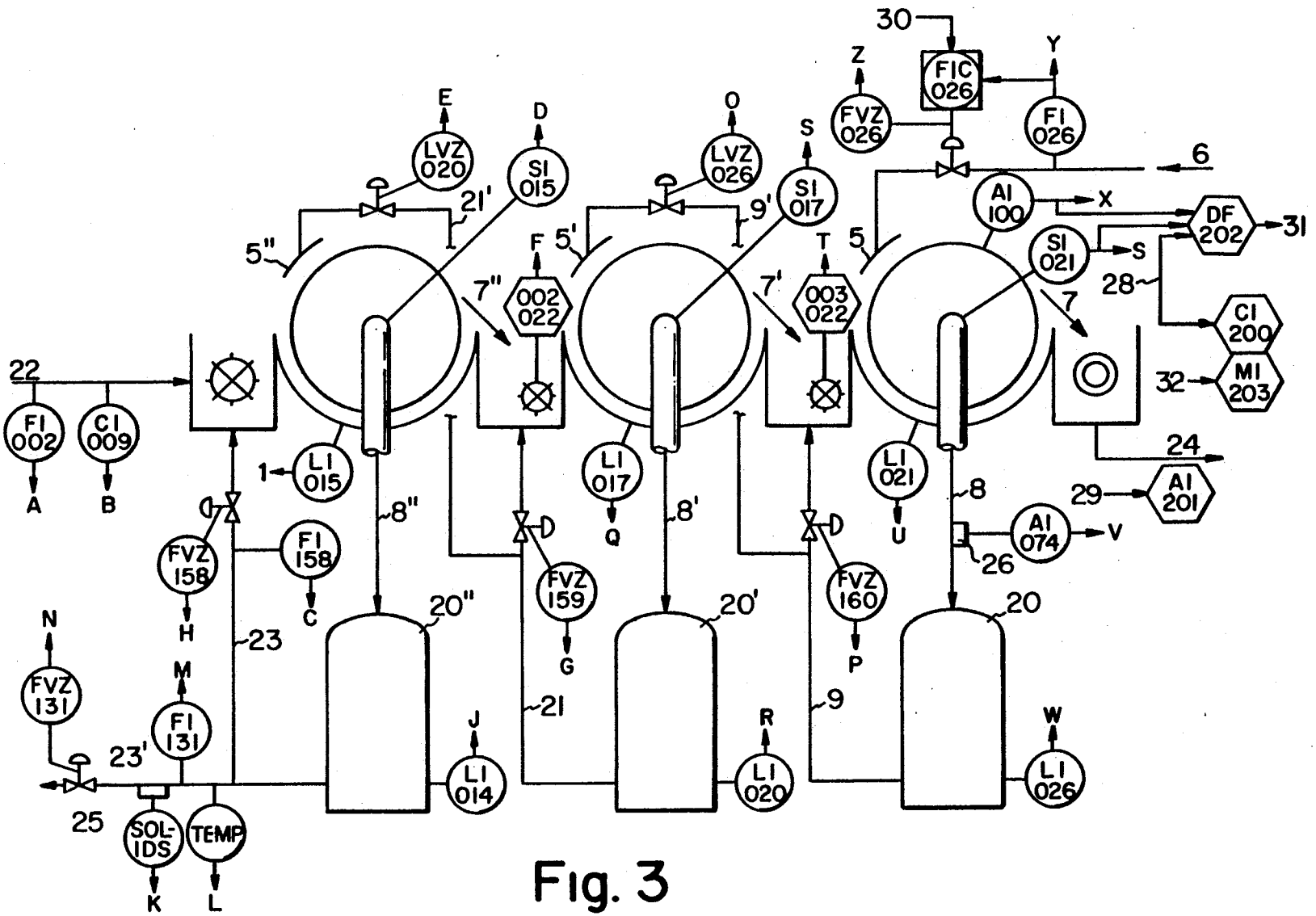
FIG. 3 is a schematic diagram illustrating the equipment for a multistage pulp washing control system according to this invention with the process measurement inputs lettered and neural network controller process control variables numbered.
Figure 4:
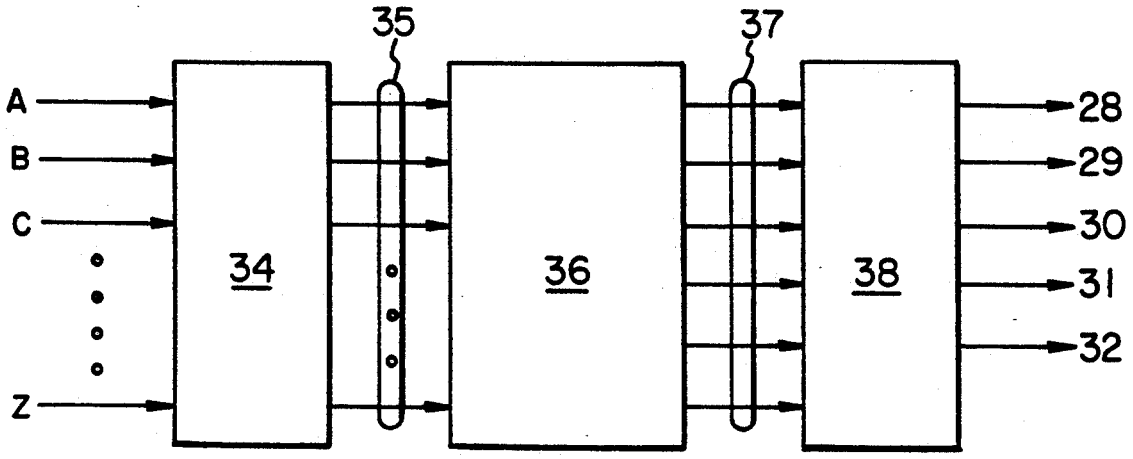
FIG. 4 is a schematic illustrating in block format the neural network controller used to control the Dilution Factor of a three-stage pulp washing process shown in FIG. 3.

According to this invention, the multivariable countercurrent pulp washing system as shown in FIG. 2, which incorporates the single stage pulp washing system shown in FIG. 1, is provided with the unique control system illustrated in schematic form in FIGS. 3 and 4. It should be noted that what is presently described is exemplary of a system actually used. The invention has application to other moving screen pulp washers such as multistage belt washers and pressure diffusion washers. There are pulp washing systems that will have more variables than used in this example and there are pulp washing systems that will have fewer variables than used in this example. However, the described techniques can be customized to the exact pulp washing system on a case-by-case basis. Referring back to FIG. 3, the tag names for process variables appear in circles, squares and hexagons. The properties or process parameters that correspond to the tag names are set forth in Table I. The variables listed in Table I are those that were measured and used to control the washer. Additional variables were originally measured and detected by applicants but were found to be of insufficient value in predicting the indirectly controlled variables.

TABLE I

| PARAMETER | TAG NAME | DESCRIPTION | VARIABLE TYPE |
|---|---|---|---|
| A | FI002 | Stock Flow to Washer | Measurement |
| B | CI009 | Stock Consistency to Washer | Measurement |

TABLE I-continued

| PARAMETER | TAG NAME | DESCRIPTION | VARIABLE TYPE |
|---|---|---|---|
| C | FI158 | #1 Washer Vat Dilution Flow | Measurement |
| D | SI015 | #1 Washer Drum Speed | Measurement |
| E | LVZ020 | #1 Washer Shower Valve Position | DCS Output |
| F | 002-022 | #1 Washer Repulper Run Status | Discrete Input |
| G | FVZ159 | #2 Washer Vat Dilution Valve Pos. | DCS Output |
| H | FVZ158 | #1 Washer Vat Dilution Valve Pos. | DCS Output |
| I | LI015 | #1 Washer Vat Level | Measurement |
| J | LI014 | #1 Washer Seal Tank Level | Measurement |
| K | SOLIDS | Weak Black Liquor Solids to Evap. | Lab Test |
| L | TEMP | Weak Black Liquor Temp. | Lab Test |
| M | FI131 | Weak Black Liquor Flow to Storage | Measurement |
| N | FVZ131 | Weak Black Liquor Valve Position | DCS Output |
| O | LVZ026 | #2 Washer Shower Valve Position | DCS Output |
| P | FVZ160 | #3 Washer Vat Dilution Valve Pos. | DCS Output |
| Q | LI017 | #2 Washer Vat Level | Measurement |
| R | LI020 | #2 Washer Seal Tank Level | Measurement |
| S | SI017 | #2 Washer Drum Speed | Measurement |
| T | 003-022 | #2 Washer Repulper Run Status | Discrete Input |
| U | LI021 | #3 Washer Vat Level | Measurement |
| V | AI074 | #3 Washer Filtrate Conductivity | Measurement |
| W | LI026 | #3 Washer Seal Tank Level | Measurement |
| X | AI100 | #3 Washer Mat Thickness | Measurement |
| Y | FI026 | #3 Washer Shower Flow | Measurement |
| Z | FVZ026 | #3 Washer Shower Valve Position | Measurement |
| 28 | CI200 | #3 Washer Mat Consistency | Network Output |
| 29 | AI201 | #3 Washer Discharge Soda Loss | Network Output |
| 30 | FIC026.SP | #3 Washer Shower Set Point | Post Proc. Val |
| 31 | DF202 | #3 Washer Dilution Factor | Post Proc. Val |
| 32 | MI203 | #3 Washer Mat Bulk Density | Network Output |

FIG. 4 shows a neural network controller that interfaces to the process shown in FIG. 3. The process variable inputs to the preprocessing section 34 of the controller are labeled with letters. The actual neural network inputs, as defined after preprocessing, are set forth in Table II.

TABLE II

| PARAMETER | TAG NAME | DESCRIPTION | VARIABLE TYPE |
|---|---|---|---|
| A | FI002 | Stock Flow to Washer | Measurement |
| A1 | FI002-1 | Stock Flow to Washer: 5 min old | History |
| A2 | FI002-2 | Stock Flow to Washer: 10 min old | History |
| A3 | FI002-3 | Stock Flow to Washer: 15 min old | History |
| B | CI009 | Stock Consistency to Washer | Measurement |
| B1 | CI009-1 | Stock Consistency: 5 min old | History |
| B2 | CI009-2 | Stock Consistency: 10 min old | History |
| B3 | CI009-3 | Stock Consistency: 15 min old | History |
| C | FI58 | #1 Washer Vat Dilution Flow | Measurement |
| D | SI015 | #1 Washer Drum Speed | Measurement |
| E | LVZ020 | #1 Washer Shower Valve Position | DCS Output |
| F | 002-022 | #1 Washer Repulper Run Status | Discrete Input |
| G | FVZ159 | #2 Washer Vat Dilution Valve Pos. | DCS Output |
| H | FVZ158 | #1 Washer Vat Dilution Valve Pos. | DCS Output |
| I | LI015 | #1 Washer Vat Level | Measurement |
| J | LI014 | #1 Washer Seal Tank Level | Measurement |
| K | SOLIDS | Weak Black Liquor Solids to Evap. | Lab Test |
| K1 | SOLIDS-1 | WBL Solids: 1 hr. old | History |
| K2 | SOLIDS-2 | WBL Solids: 2 hr. old | History |
| K3 | SOLIDS-3 | WBL Solids: 3 hr. old | History |
| L | TEMP | Weak Black Liquor Temp. | Lab Test |
| L1 | TEMP-1 | Weak Black Liquor Temp.: 1 hr. old | History |
| L2 | TEMP-2 | Weak Black Liquor Temp.: 2 hr. old | History |
| L3 | TEMP-3 | Weak Black Liquor Temp.: 3 hr. old | History |
| M | FI131 | Weak Black Liquor Flow to Storage | Measurement |
| M1 | FI131-1 | WBL Flow to Storage: 5 min old | History |
| M2 | FI131-2 | WBL Flow to Storage: 10 min old | History |
| M3 | FI131-3 | WBL Flow to Storage: 15 min old | History |
| N | FVZ131 | Weak Black Liquor Valve Position | DCS Output |
| O | LVZ026 | #2 Washer Shower Valve Position | DCS Output |
| P | FVZ160 | #3 Washer Vat Dilution Valve Pos. | DCS Output |
| Q | LI017 | #2 Washer Vat Level | Measurement |
| R | LI020 | #2 Washer Seal Tank Level | Measurement |
| S | SI017 | #2 Washer Drum Speed | Measurement |
| T | 003-022 | #2 Washer Repulper Run Status | Discrete Input |
| U | LI021 | #3 Washer Vat Level | Measurement |
| V | AI074 | #3 Washer Filtrate Conductivity | Measurement |
| W | LI026 | #3 Washer Seal Tank Level | Measurement |
| X | AI100 | #3 Washer Mat Thickness | Measurement |
| Y | FI026 | #3 Washer Shower Flow | Measurement |
| Y1 | FI026-1 | #3 Washer Shower Flow: 5 min. old | History |
| Y2 | FI026-2 | #3 Washer Shower Flow: 10 min. old | History |
| Y3 | FI026-3 | #3 Washer Shower Flow: 15 min. old | History |

TABLE II-continued

| PARAMETER | TAG NAME | DESCRIPTION | VARIABLE TYPE |
|---|---|---|---|
| Z | FVZ026 | #3 Washer Shower Valve Position | Measurement |

The neural network inputs are collectively passed by bus 35 to the trained network 36. The neural network was implemented as set forth in the Grayson and Rudd application. The collective outputs of the network are passed on bus 37 to the post-processing section 38, for processing and ultimately define the set point values for the controlled variables labeled with numbers 28 through 32 which include the rinse water rate. Preprocessing and post-processing were implemented by a programmed digital computer.

Two specific application embodiments are described. First, the Dilution Factor (DF) concept is used to improve the variability in the solids removed from the pulp passing through the washing system in an effort to minimize the fresh and/or reused water which ultimately must be evaporated by the recovery system. Second, the Displacement Ratio (DR) concept is used for the same purpose. It will be shown that these methods are closely related and either will work well.

DF Embodiment

Referring to the first preferred embodiment, the Dilution Factor (DF) has long been applied to countercurrent pulp washing and its, Dilution Factor, relationship to washing efficiency and washer performance has been elaborated upon in the prior art. The common definition, and the one used for the purposes of this embodiment, relates the mass of fresh wash liquor added to the system to the mass of solid pulp flowing through the system as follows:

$$DF = \frac{[F6 * (1 - S6)] - \{F7 * (1 - S7) * [(100 - C7)/100]\}}{F7 * (C7/100)}$$

where, referring back to FIG. 1, the mass flow rate of the wash liquor stream 6 to the showers 5 is equal to F6*(1−S6) where F6 is in terms of units of mass per time and S6 is in terms of the solids fraction in the wash liquor stream 6. The liquid leaving the system in pulp stream 7 is equal to F7*[(100−C7)/100] where F7 is in terms of units of mass per time and C7 the consistency of the pulp stream 7 leaving the washer and is expressed in terms of percent pulp mass per total mass in the pulp stream 7. The water content of the liquid stream 7 is then expressed as F7*(1−S7)*[(100−C7)/100] where S7 equals the fractional solids content of the stream containing spent chemicals which are commonly referred to in the industry as soda loss. As relating to this particular embodiment, the wash liquor stream 6 is fresh or reclaimed water and the solids fraction S6 is 0. Therefore, the above equation reduces to:

$$DF = \frac{F6 - \{F7 * (1 - S7) * [(100 - C7)/100]\}}{F7 * (C7/100)}$$

Finally, the mass flow of the stock passing through the washer system is expressed as F7*(C7/100).

Having reliable values for at least S7, C7 and F7, as provided by the neural network, lets the shower flow to the washer for a selected DF be determined by the following equation:

$$F6 = F7/100 * [C7*DF + (1 - S7)*(100 - C7)].$$

While F7, in some cases, can be accurately and continuously measured, C7 and S7 cannot. The neural network, however, can be trained to reliably predict F7, C7 and S7. From these values, the set point for F6 can be calculated. In terms of the Grayson and Rudd application, the formula is calculated as a post-processing rate, the result of which is then fed to the flow controller, FIC026, as a set point for that loop to maintain the target DF. The DF can be adjusted by the operator until the most economical balance between washer efficiency and weak liquor solids is reached. The neural network itself could be trained to adjust the DF for optimum results.

In a typical pulp processing facility, the pulping process is adjusted based on the required mass of solid wood fiber to be produced to meet the pulp mill's overall production demand, i.e., customer order requirements. Therefore, a stream of pulp (F7) is produced at a relatively constant rate, and passed to a pulp washing system as shown schematically in FIGS. 2 and 3. It has been shown by others that adjusting the shower flow to the pulp washers to maintain a constant DF lo provides uniform washer efficiency and performance as well as constant weak liquor solids flow to the recovery system for any set of constant operating conditions. The key to the above is the use of accurate, real-time predictions of values for consistency C7 and solids fraction S7 which are provided by the neural network.

Table II represents the input variables, according to the chosen implementation, that the neural network controller uses to determine the values for the above. The variables used as inputs to the network fall into three categories: first, variables that represent present values obtained by the control system by various measurement means; second, variables that represent measured values that have been averaged and stored historically as fixed period averages, e.g., five or six minute averages; and third, variables that are sampled manually and entered into the control system on a periodic basis, e.g., hourly.

Figure 5B:
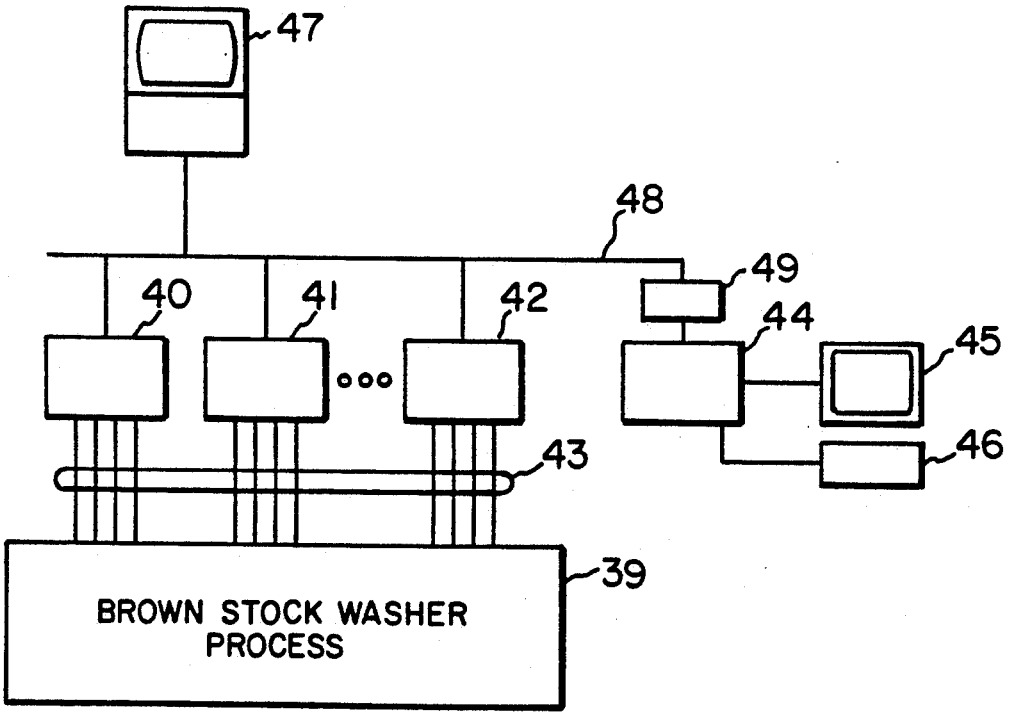
FIGS. 5A and 5B are schematic illustrations in block format of an embodiment using a personal computer for the neural network controller interfaced to a Bailey Network 90 distributed control system (DCS)
Figure 5A:
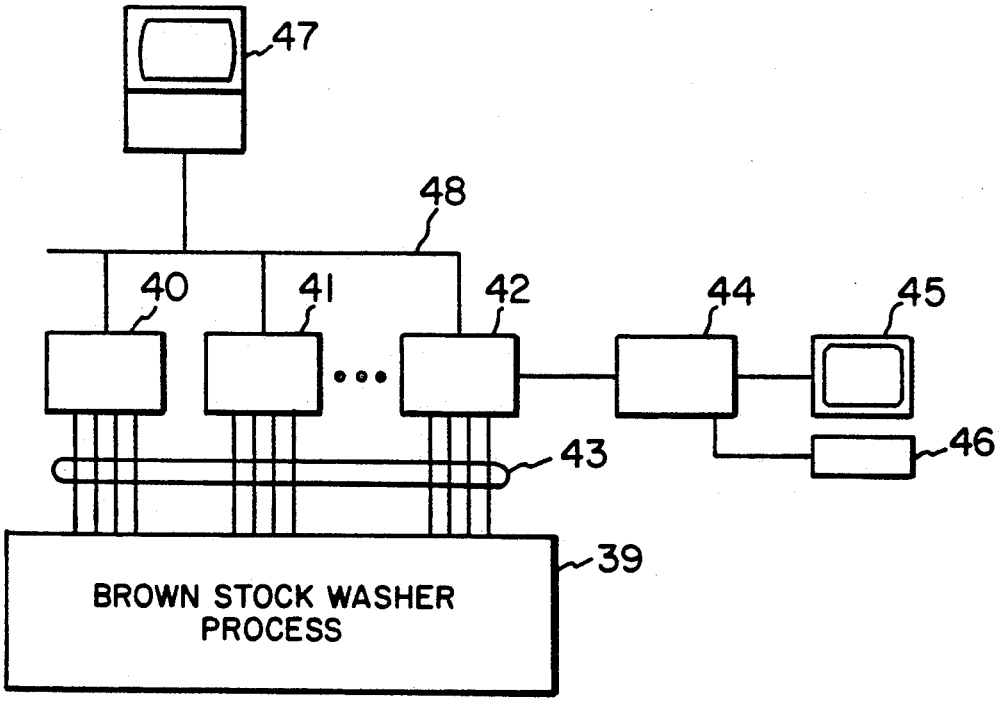

Referring to FIG. 5A, one physical implementation of this invention was performed using a personal computer 44 interfaced to a Bailey Controls Network 90 distributed controls system (DCS). Again, the equipment selected and used is exemplary as there are other DCS systems that can be equally used. The brown stock washing process, represented collectively as block 39, has numerous individual measurement devices which are directly wired, collectively 43, to the Network 90 microprocessor control devices (40, 41, 42, etc.) known as multifunction controllers (MFCs). These MFCs are connected together on a common local area communication network 48 with operator interface capability being provided on a video-based Management Command Station (MCS) 47. A personal computer 44 with monitor 45 and keyboard 46 are connected directly to MFC 42 via a standard serial communication link. The software program for implementing the trained neural network is resident in the personal computer 44.

Another equally effective method of communication is represented in FIG. 5B showing the communication taking place over the communication network via a Bailey Computer Interface Unit (CIU) 49. As stated, this method is equally effective considering the timing of the process since the communication over the communication bus will be slightly slower than the direct serial interface. Portions of the control system reside in the DCS system while portions reside in the personal computer.

One MFC, 42, was dedicated to: 1) Collecting data from the various MFCs that are a part of the collective DCS control system, 40 and 41; 2) Performing preliminary preprocessing of the collected data and placing the data in a form to be passed to the neural network; 3) Performing communication functions with the personal computer containing the balance of the neural network controller software; and 4) Final post-processing with communications back to the other MFCs in the DCS system. The personal computer, 44, contains software that performs historization of input data, final preprocessing of the inputs, neural network execution, historization of network execution results, preliminary post-processing of output data including calculation of relational control factors and communications back to the dedicated MFCs. The data collection and preliminary pre-/post-processing rules used to prepare the inputs (listed in Table II) along with the communication configuration are exhibited in FIGS. 6, 7 and 8 which are screen prints of Bailey configuration source documents before compilation and loading into the MFC.

Figure 6:
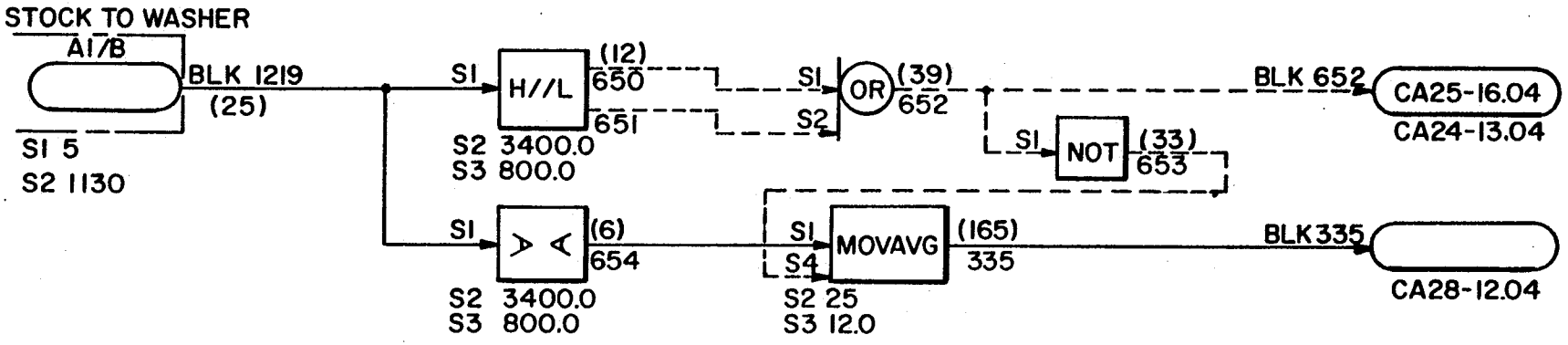
FIGS. 6 through 8 are reproductions of Bailey Network 90 (Product of Bailey Controls Company) configuration drawings after compilation.

FIG. 6 represents the collection and preprocessing of a variable which is obtained by the control system by various measurement means. The value of a variable is checked against expected upper and lower limits. If outside the limits, an alarm condition is noted. If within the limits, the value is used to advance a rolling average. The rolling average is then passed along. One variable is represented; namely, Stock Flow to Washer. This will be used for exemplary reasons, as the other loops are similar. Note that from this point, the algorithms described as function blocks are Bailey Control software, and are used to describe this particular implementation. (In the Bailey Control system, software is graphically written by assembling standard function blocks and interconnecting the blocks upon the computer display. The assembled and interconnected blocks serve as source code for assembly into the object code that actually implements the computer control.) Other control system manufacturers have similar methods of describing and implementing standard software functions.

The function block (1219 which represents a physical address location) on the left-most side of the document uses a communication algorithm 25 which requests and retrieves an analog value from another MFC over the Bailey communication bus. The specification numbers (i.e., S1 and S2) directly below the function symbol indicate that the value is retrieved from module address 5, block 1130 where the module number represents a bus address of the source MFC and the block number represents a physical storage location within the source MFC. The analog value retrieved and now stored in block address 1219 is passed to another algorithm function (shown as H//L) which compares the value to limits stored in specifications S2 and S3. If the value in 1219 is greater than or equal to the value in S2, a Boolean value of 1 is stored in block address 650. If the value in 1219 is less than or equal to the value in S3, a Boolean value of 1 is stored in block address 651. If the value in 1219 does not violate either limit, Boolean values of 0 are stored in both addresses. A logical OR algorithm is used to combine the two Boolean values in block addresses 650 and 651 with the result being stored in block address 652 which represents an alarm status for any time the limits are violated. The alarm status from 652 is also passed to a NOT block with the result of the NOT operation being stored in block address 653. This Boolean value is used as an initialization signal to a moving average block described later. The limits chosen in each case are the upper and lower limits used for the individual input value when the neural network is being trained. The analog value in block 1219 is also passed to a high/low limit algorithm (shown as a box containing the not greater than and not less than symbols) which compares the value to limits stored in its specifications S2 and S3. If the value in 1219 is greater than or equal to the value in S2, the limit value in S2 is stored in block address 654. If the value in 1219 is less than or equal to the value in S3, the limit value stored in S3 is stored in block address 654. If the value in 1219 does not violate either limit, the actual value of 1219 is stored in block address 654. The value stored in block address 654 is passed to a moving average (shown as MOVAVG) which performs a moving average using the number of samples indicated in S2 (i.e., 25) which have been collected with a frequency as indicated in S3 (12 sec.) with the resulting average stored in block address 335. Block address 335 is one block in a contiguous block of addresses selected from collectively passing all values to the personal computer. On the far right side of the drawing, symbols are found that are used at compilation time. Referring to the upper symbol, it simply indicates that the digital value of block address 652 is passed to other configuration drawings where it is used in other logic. The numbers inside and below the oval box indicate that the drawings to which the value of 627 is passed are drawings 25 and 24 of the configuration set CA and the entry point into the destination drawings are coordinates 16.04 and 13.04, respectively, where the number to the left of the decimal represents the vertical position indicated by the numbers on the left and right margins of the drawings and the number to the right of the decimal represents the horizontal position indicated by the numbers on the top and bottom margins of the drawings.

Figure 7:
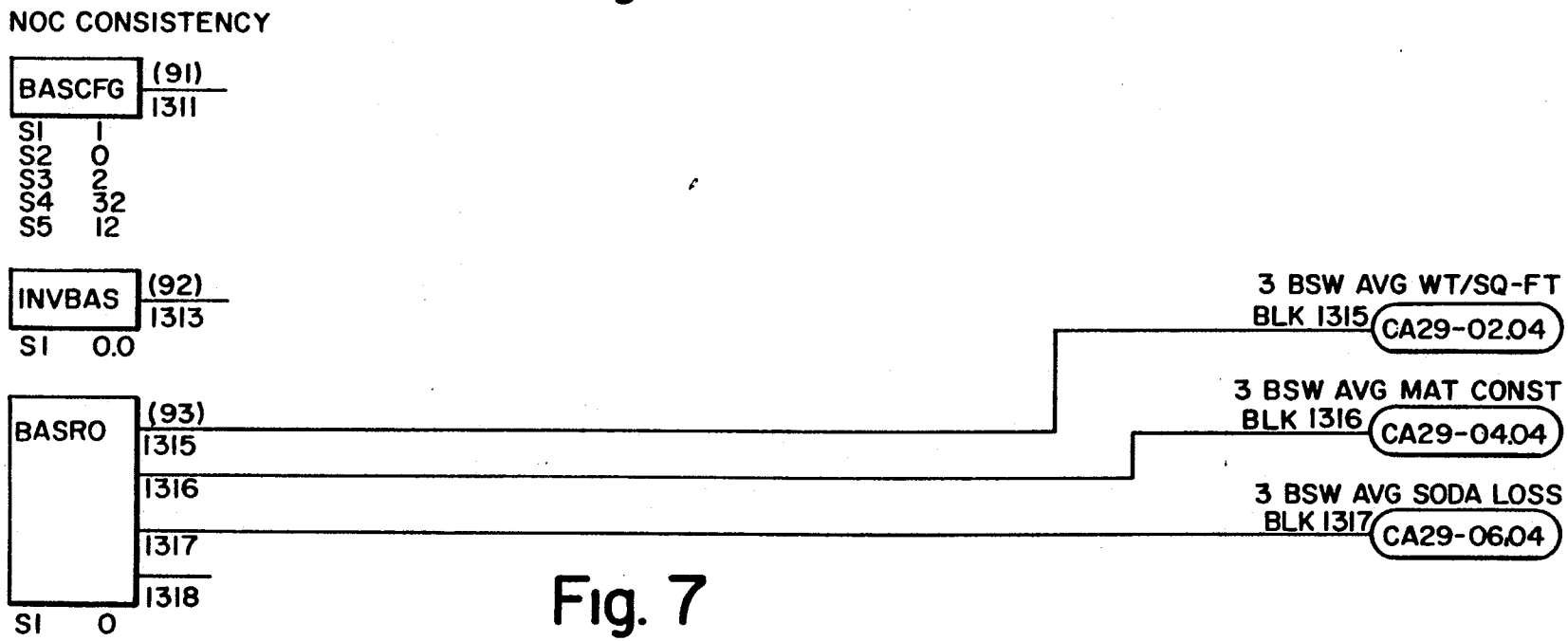

FIG. 7 is the configuration that sets up the communication between the MFC and the personal computer. The MFC has the capability of having a compiled interpretive BASIC or compiled C program loaded directly into its operating memory. In this example, as is shown by the figure, there is a function block using a configuration algorithm, shown as BASCFG, that is used to define memory allocated to a BASIC program, where the specification numbers, S1 to S5, provide the definition. A function block using an invocation algorithm, shown as INVBAS, is used to cause the MFC BASIC interpreter to call and execute the neural network program. Finally, a function block using a data storage algorithm, shown as BASRO, is used to provide four real value block addresses, 1315 to 1318, that can be defined by the BOUT command in the BASIC program.

The first three outputs are used for storing the mat consistency, mat bulk density and soda loss, which are the three direct outputs of the neural network itself. These values, blocks 1315, 1316 and 1317, are passed to other drawings as indicated by the cross references and are then broadcast to the communication network to be picked up and used by other MFCs, as required, or displayed at the MCS for the operator.

Figure 8:
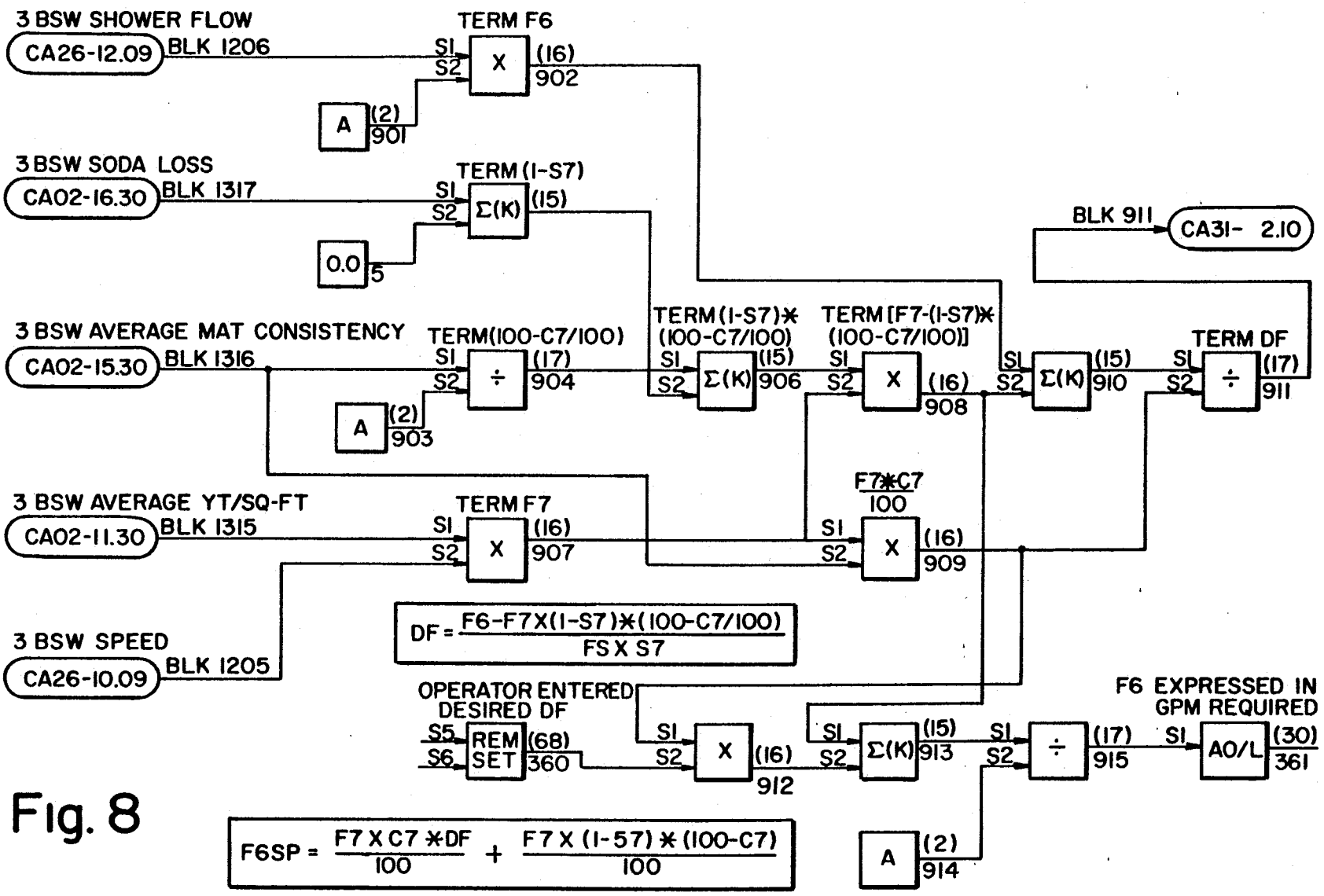

FIG. 8 represents the post-processing rules, as described in the Grayson and Rudd application, that are used to take the mat density, mat consistency and desired Dilution Factor along with current present values of required measurements to generate a set point present value for the required shower flow 6. This set point value for shower flow is updated every time that the neural network runs, which results in a value that can be used by the distributed control system continuously in the same manner as a value obtained by a continuous measurement means. A detailed description of the drawing is not presented as it should be clear to someone skilled in the art.

DR Embodiment

The second embodiment relates to the use of the concept of Displacement Ratio (DR) which is another concept familiar to those skilled in the industry and seeks to quantify the degree to which the wash liquor applied via the showers displaces the vat liquor in the stock mat as it passes over the drum face.

Referring back to Figure the Displacement Ratio (DR) for the application as defined for the purpose of this invention shall be the ratio of the dissolved solids content, S10, in the washer vat 10 less the solids content, S7, in the pulp mat 7 leaving the washer and the dissolved solids content S10 less the solids content, S6, in the wash liquor stream 6. The algebraic expression of this ratio is as follows:

$$DR = \frac{S10 - S7}{S10 - S6}$$

Under ideal conditions, the wash liquor stream 6 applied at the showers 5 would completely displace the vat liquor remaining in the pulp stock stream 7 as it is transported over the drum face. In the ideal situation, S7 and S6 are approximately the same and the above expression reduces to the following:

$$DR = \frac{(S10 - S7)}{(S10 - S6)} = 1.0$$

This ideal condition never exists, however, and DR values in real situations are found to run in the 0.4 to 0.9 range under actual operating conditions. Nevertheless, increasing the Displacement Ratio will, in general, yield improved performance (i.e., solids removal) of the pulp washer or pulp washing system.

Displacement Ratios are affected by a number of factors which are generally divided into two categories: Process and Mechanical. Process variables refer to those variables which an operator has control of on a real-time basis via the process control system; i.e., shower flows, stock flows, vat dilution, drum speed, etc. Mechanical variables refer to either system design parameters, such as pumping capacities and shower bar arrangements, as well as equipment failures like holes in pipes and face wires or excessive wear in rotating surfaces that cannot be repaired until regularly scheduled outages typically occurring on a monthly basis.

It has been shown by Perkins et al. that the theoretical Displacement Ratio is a function of the consistency C7 leaving the washer and the number of shower headers:

$$DR = 1 - \frac{[n5 * WP7]}{[(n5 + 1) * WP7 * DF]}$$

where n5 is the number of headers in shower 5, DF is the Dilution Factor and WP7 is the weight of the liquor in the pulp leaving the washer per weight of the pulp expressed as:

$$WP7 = (100 - C7) / C7$$

where C7 is the pulp consistency as previously defined. By substituting the previously define DF equation, the above becomes:

$$DR = 1 - \left[ \frac{n5 * WP7}{\frac{(n5 + 1) * WP7 * (F6 - F7 * (1 - S7))}{F7 * S7}} \right]^{n5}$$

an accurate determination of the values for C7, S7, F7 and hence WP7, is provided by the neural network controller. The shower flow to the washer can be determined by the following equation:

$$F6 = F7 * \frac{\{[n5 * S7] + (1 - S7)\}}{(1 - DR)^{1/n5} * (n5 + 1)}$$

which is a post-processing rule that uses the neural network generated mat density, mat consistency along with the desired Displacement Ratio to generate set point present value for the required shower flow 6 in the same manner as was shown in the previous embodiment. Configuration drawings similar to FIGS. 6, 7 and 8 have not been included, however the above strategy can be implemented in the same manner by those skilled in the art.

Regardless of the preferred embodiment chosen by an individual for generating the desired present value for the shower flow 6, the DR or DF can be adjusted by the operator until the most economical balance between washer efficiency and weak liquor solids is reached.

In some cases, a plurality of neural networks are used for at least one of the following reasons: (1) the process time constants for some of the indirectly controlled variables are significantly different; (2) to segregate indirectly controlled variables into logical groupings; and/or (3) to optimize the processing timing cycle requirements of different indirectly controlled variables. All of the variables can be integrated into one neural network, however, the required training time and required execution time of the trained network would be adversely affected.

The above-described processes are representative of one washing application that is common to the pulp and paper-making industry. It should be understood that this is exemplary of numerous washing systems commonly used in the pulp and paper-making industry which may be controlled according to this invention, including diffusion pulp washing systems, displacement pulp washing systems, flat belt washing systems (See U.S. Pat. Nos. 4,046,621 and 4,863,784), rotary drum belt washing systems, the above washing systems as applied to bleach pulp washing systems, etc. This invention can also be applied to numerous other washing processes in other industries where the basic concept is the washing of a slurry mat undergoing incomplete liquid separation.

Having thus described our invention with the detail and particularity required by the Patent Law, what is claimed and desired to be protected by Letters Patent is set forth in the following claims.

We claim:

1. A control system for a countercurrent pulp washing process in which the pulp is formed as a pulp mat on at least one moving filter surface and that mat is supplied with rinse water to replace water in the pulp mat thereby reducing dissolved organic and inorganic material in the mat before it is removed from the filter surface characterized by measured and directly controlled process variables including flow rate of fresh rinse waster, measured and uncontrolled process variables, at least one predictable process variable including dissolved solids retained in the pulp mat, said process variables having values that define the state of the pulp washing process, said system comprising:

control means responsive to set point values for establishing the value of the directly controlled process variables including the rate of fresh rinse water at said set point values applied to said control means, means for implementing a trainable neural network having a plurality of input neurons for having input values applied thereto and output neurons for providing output values, means for training the neural network to provide predicted values for the predictable process variable including mat consistency, mat bulk density, and soda loss at output neurons, said predicted values corresponding to the input values of the neural network, means for measuring the values of measured process variables, means for establishing and continuously updating a computer database to store the values of measured process variables, computer means for establishing the input values at the input neurons of the neural network based upon the values of process variables stored in the computer database, means for establishing a set point control factor, computer means for calculating a control factor from measured and predicted process variables and for comparing the calculated control factor to the set point control factor, computer means for establishing set point values to be applied to control means, said control system so constructed and arranged that said computer means for establishing set point values, after the neural network has been trained to predict the value of the predictable process variable, changes the set point value of the rate of fresh rinse water to cause the calculated control factor to approach the set point control factor.

2. The system according to claim 1 wherein the control factor is a factor that relates the mass of rinse water added to the system to the mass of pulp flowing through the system.

3. The system according to claim 1 wherein the control factor is the a factor that relates the degree to which the rinse water displaces water in the pulp mat.

* * * * *

UNITED STATES PATENT AND TRADEMARK OFFICE

CERTIFICATE OF CORRECTION

PATENT NO. : 5,282,131 Page 1 of 2

DATED : January 25, 1994

INVENTOR(S) : John B. Rudd and David L. DeGroot

It is certified that error appears in the above-indentified patent and that said Letters Patent is hereby corrected as shown below:

TITLE PAGE

Abstract Line 10 after "neurons" insert --for--.

Column 3 Line 63 "Seymore" should read --Seymour--.

Column 3 Line 67 "Seymore" should read --Seymour--.

Column 4 Lines 25-26 "Controlled" should read --controlled--.

Column 10 Line 29 before "provides" delete --lo--.

Column 12 Line 29 "from" should read --for--.

Column 13 Line 24 "Figure" should read --FIG. 1,--.

Column 13 Line 46 insert --as S7 approaches S6--.

Column 14 Line 13 "define" should read --defined--.

Column 15 Line 4 "Law" should read --Laws--.

UNITED STATES PATENT AND TRADEMARK OFFICE

CERTIFICATE OF CORRECTION

PATENT NO. : 5,282,131 Page 2 of 2

DATED : January 25, 1994

INVENTOR(S) : John B. Rudd and David L. DeGroot

It is certified that error appears in the above-indentified patent and that said Letters Patent is hereby corrected as shown below:

Claim 1 Line 10 Column 15 "that" should read --the--.

Claim 1 Line 22 Column 15 "value" should read --values--.

Claim 3 Line 31 Column 16 "the a" should read --a--.

Signed and Sealed this

Twenty-first Day of June, 1994

*Attest:*

Bruce Lehman

BRUCE LEHMAN

*Attesting Officer*

*Commissioner of Patents and Trademarks*